US007166562B2

(12) United States Patent
Blahey et al.

(10) Patent No.: US 7,166,562 B2
(45) Date of Patent: Jan. 23, 2007

(54) LONG LIFE GAS ENGINE OIL AND ADDITIVE SYSTEM

(75) Inventors: Alan Gary Blahey, Sarnia (CA); Stanley James Cartwright, Sarnia (CA)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/806,873

(22) PCT Filed: Oct. 13, 1998

(86) PCT No.: PCT/US98/21595

§ 371 (c)(1),
(2), (4) Date: Apr. 3, 2001

(87) PCT Pub. No.: WO00/22070

PCT Pub. Date: Apr. 20, 2000

(65) Prior Publication Data

US 2003/0182849 A1 Oct. 2, 2003

(51) Int. Cl.
*C10M 129/10* (2006.01)
*C10M 129/26* (2006.01)

(52) U.S. Cl. ..... 508/584; 508/460

(58) Field of Classification Search ..... 508/526, 508/584, 585, 587, 460
See application file for complete search history.

(56) References Cited

U.S. PATENT DOCUMENTS

| | | | | |
|---|---|---|---|---|
| 3,396,114 | A * | 8/1968 | Vienna | 252/75 |
| 4,812,246 | A * | 3/1989 | Yabe | 508/364 |
| 5,108,634 | A * | 4/1992 | Seiki | 508/584 |
| 5,726,133 | A * | 3/1998 | Blahey et al. | 508/390 |
| 5,744,430 | A * | 4/1998 | Inoue et al. | 508/295 |
| 5,807,813 | A * | 9/1998 | Yamada | 508/363 |
| 6,191,081 | B1 * | 2/2001 | Cartwright et al. | 508/460 |

OTHER PUBLICATIONS

Mortier, R.M. Chemistry and Technology of Lubricants, p. 71. Blackie-VCH Publishers, Inc. 1992.*

* cited by examiner

*Primary Examiner*—Cephia D. Toomer
(74) *Attorney, Agent, or Firm*—Joseph J. Allocca

(57) ABSTRACT

A gas engine oil of enhanced life as evidenced by a reduction in viscosity increase, oxidation, nitration. TAN increase, and TBN depletion comprises a major amount of a base oil of lubricating viscosity and at minor amount of a phenolic anti oxidant and a viscosity index improver, but excluding amine type anti oxydants.

4 Claims, 4 Drawing Sheets

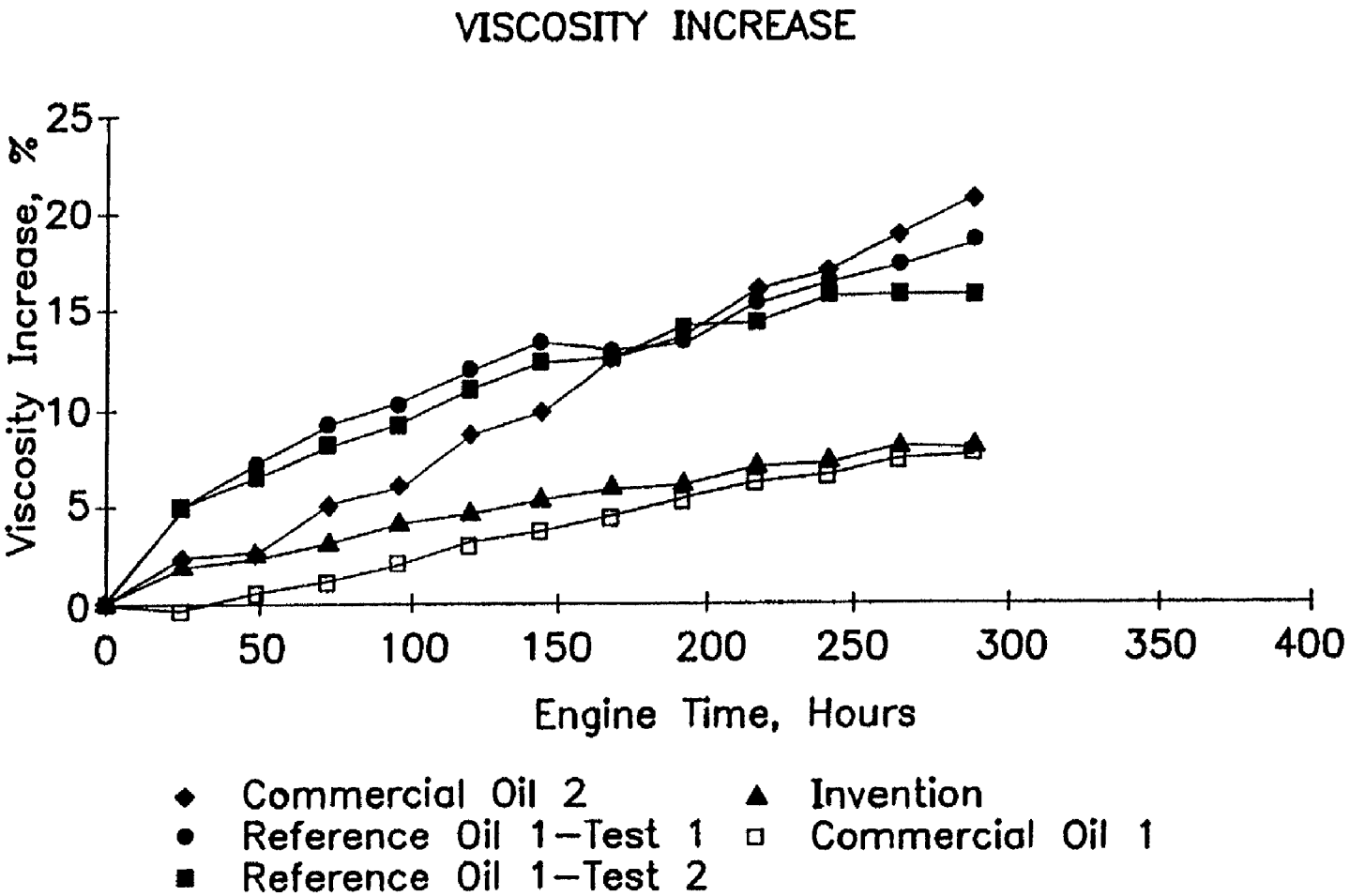
FIG. IA

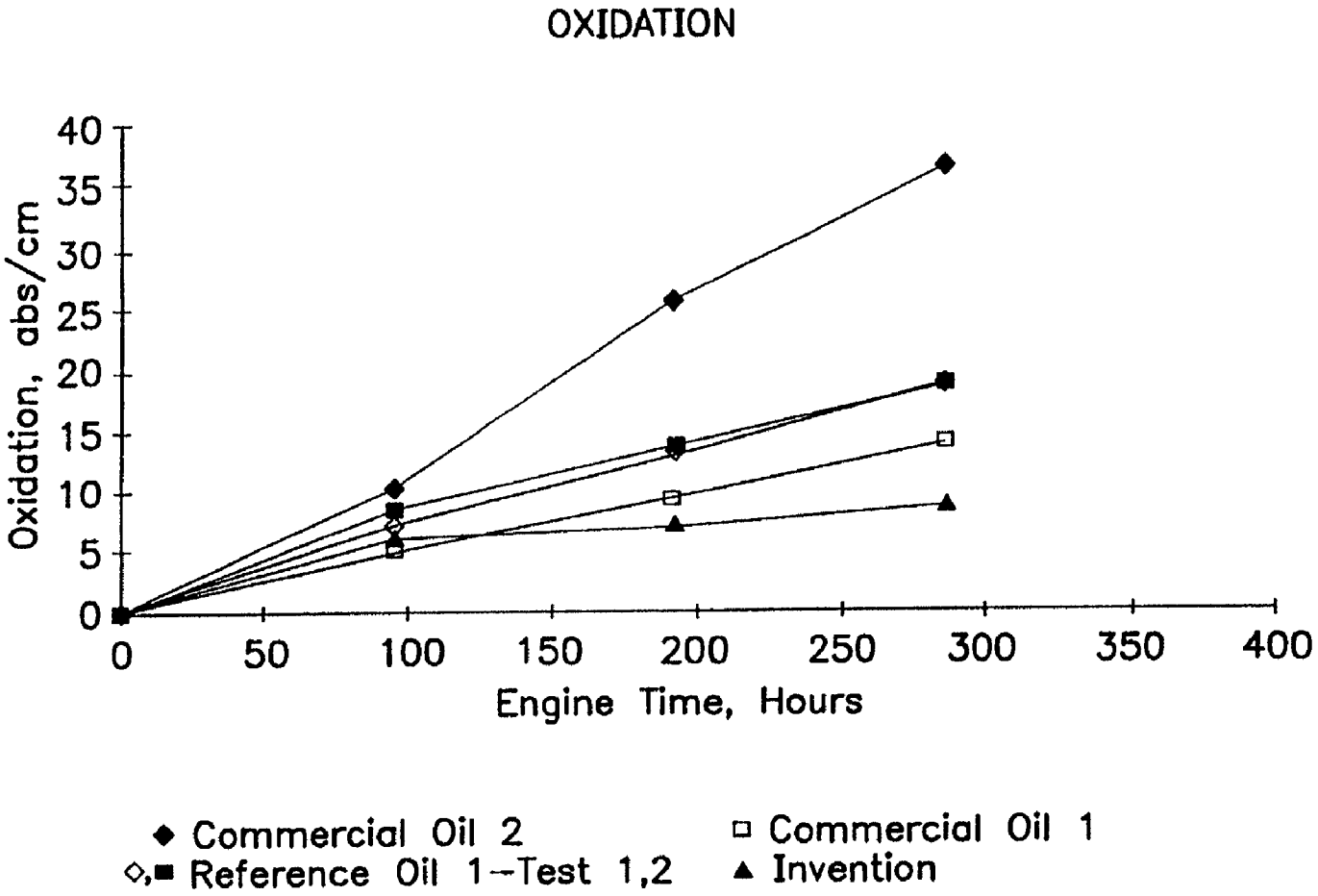
FIG. IB

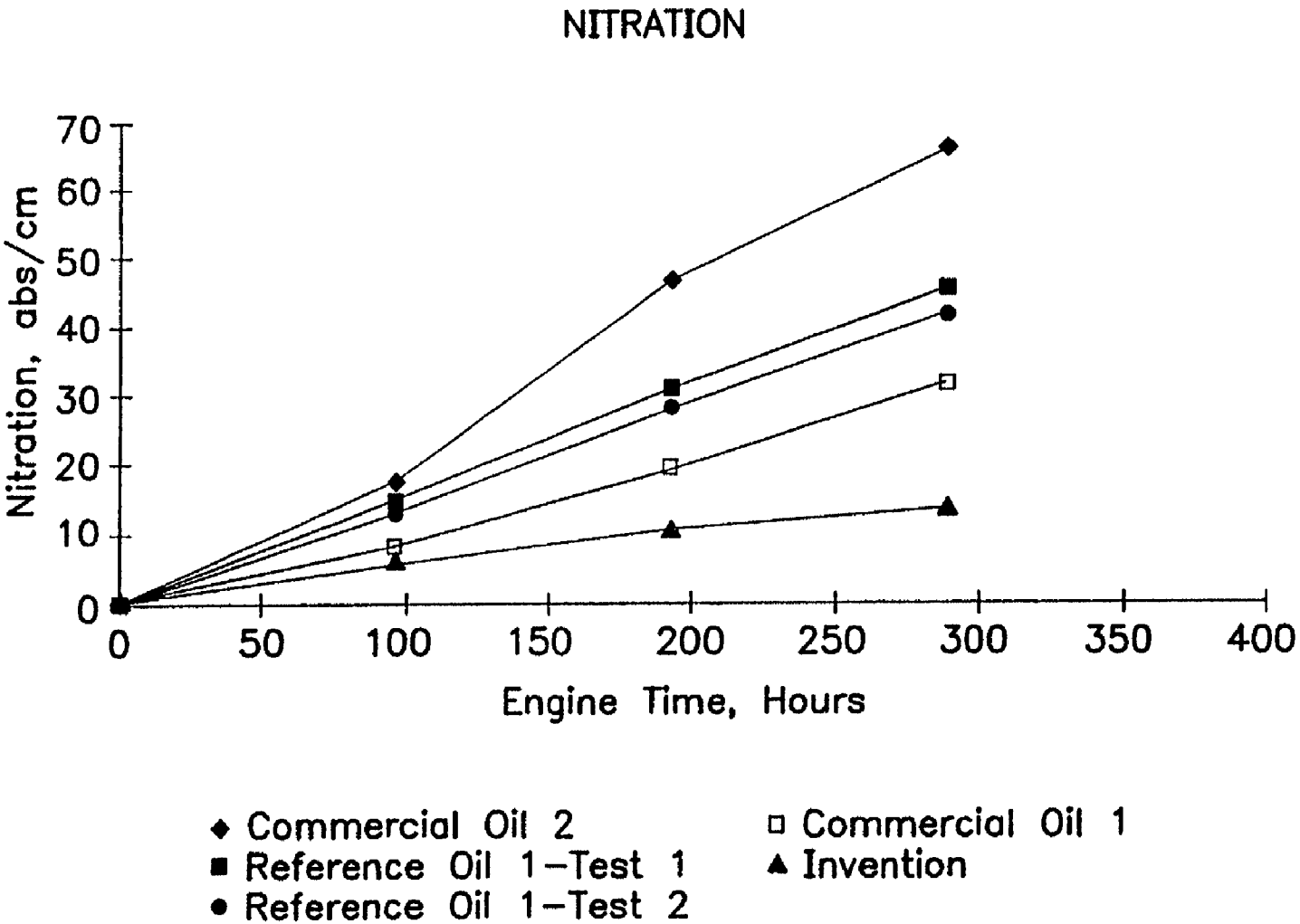
FIG. IC

LONG LIFE GAS ENGINE OIL AND ADDITIVE SYSTEM

FIELD OF THE INVENTION

The present invention relates to gas engine oils of enhanced life as evidenced by a reduction in viscosity increase, oxidation, nitration, TAN increase, and TBN depletion comprising a base oil of lubricating viscosity and a particular combination of anti oxidants and viscosity index improver additives.

BACKGROUND OF THE INVENTION

Natural gas fired engines are large, having up to 16 cylinders, and often generating between 500–3000 HP. The engines are typically used in the Oil and Gas industry to compress natural gas at well heads and along pipelines. Due to the nature of this application, the engines often run continuously near full load conditions, shutting down only for maintenance such as for oil changes. This condition of running continuously near full load places severe demands on the lubricant. Indeed, since the lubricant is subjected to a high temperature environment, the life of the lubricant is often limited by oil oxidation processes. Additionally, since natural gas fired engines run with high emissions of oxides of nitrogen ($NO_x$), the lubricant life may also be limited by oil nitration processes. Therefore, it is desirable for gas engine oils to have long life through enhanced resistance to oil oxidation and nitration.

The combustion of diesel fuel often results in a small amount of incomplete combustion (e.g., exhaust particulates). The incombustibles provide a small but critical degree of lubrication to the exhaust valve/seat interface, thereby ensuring the durability of both cylinder heads and valves. The combustion of natural gas is often very complete, with virtually no incombustible materials. Therefore, the durability of the cylinder head and valve is controlled by the properties of the lubricant and its consumption rate. For this reason, gas engine oils are classified according to their ash content, since it is the lubricant ash which acts as a solid lubricant to protect the valve/seat interface. The oil industry has accepted guidelines which classify gas engine oils according to their ash level. The classifications are:

| Ash Designation | Ash Level (wt %, ASTM D874) |
|---|---|
| Ashless | Ash < 0.1% |
| Low Ash | 0.1 < Ash < 0.6 |
| Medium Ash | 0.6 < Ash < 1.5 |
| High Ash | Ash > 1.5 |

The ash level of the lubricant is often determined by its formulation components, with metal-containing detergents (e.g., barium, calcium) and metallic-containing antiwear additives contributing to the ash level of the lubricant. For correct engine operation, gas engine manufacturers define lubricant ash requirements as part of the lubricant specifications. For example, manufacturers of 2-cycle engines often require the gas engine oil to be Ashless in order to minimize the extent of harmful deposits which form on the piston and combustion chamber area. Manufacturers of 4-cycle engines often require the gas engine oils to be Low, Medium or High Ash to provide the correct balance of engine cleanliness, and durability of the cylinder head and valves. Running the engine with too low an ash level will likely result in shortened life for the valves or cylinder head. Running the engine with too high an ash level will likely cause excessive deposits in the combustion chamber and upper piston area.

Gas engine oil of enhanced life as evidenced by an increase in the resistance of the oil to oxidation, nitration and deposit formation is the subject of U.S. Pat. No. 5,726,133. The gas engine oil of that patent is a low ash gas engine oil comprising a major amount of a base oil of lubricating viscosity and a minor amount of an additive mixture comprising a mixture of detergents comprising at least one low Total Base Number (TBN) alkali or alkaline earth metal salt having a TBN of about 250 and less and a second alkali or alkaline earth metal salt having a TBN lower than the aforesaid component. The TBN of this second alkali or alkaline earth metal salt will typically be about half or less that of the aforesaid component.

The fully formulated gas engine oil of U.S. Pat. No. 5,726,133 can also typically contain other standard additives known to those skilled in the art, including dispersants (about 0.5 to 8 vol %), phenolic or aminic anti oxidants (about 0.05 to 1.5 vol %), metal deactivators such as triazoles, alkyl substituted dimercaptothiadiazoles (about 0.01 to 0.2 vol %), anti wear additives such as metal di thiophosphates, metal dithiocarbamates, metal xanthates or tricresylphosphates (about 0.05 to 1.5 vol %), pour point depressants such as poly(meth) acrylates or alkyl aromatic polymers (about 0.05–0.6 vol %), anti foamants such as silicone antifoaming agents (about 0.005 to 0.15 vol %), and viscosity index improvers, such as olefin copolymers, polymethacrylates, styrene-diene block copolmyers, and star copolymers (up to about 15 vol %, preferably up to about 10 vol %).

DESCRIPTION OF THE FIGURES

FIGS. 1A, 1B and 1C present engine tests comparing formulations of the present invention against prior art formulations in terms of viscosity increase, nitration levels and oxidation levels versus engine time (hours).

SUMMARY OF THE INVENTION

Figure 2:
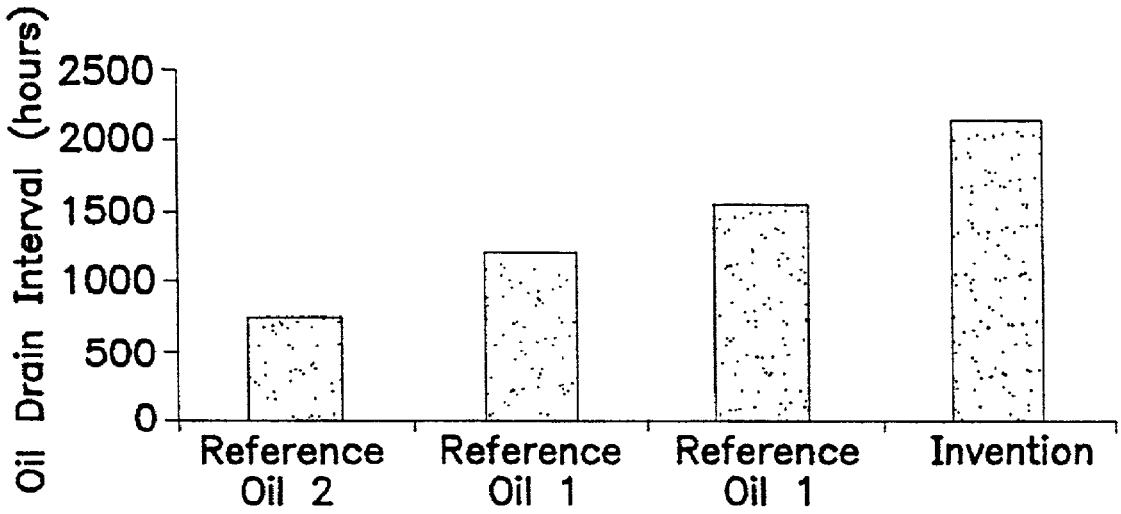
FIG. 2 presents field test results in terms of drain interval (hours) for prior art commercial formulation (historic data) versus formulation of the present invention.

The present invention relates to a gas engine lubricating oil of enhanced life as evidenced by reductions in viscosity increase, oxidation, nitration, TAN increase, and TBN depletion, which comprises a major amount of a base oil of lubricating viscosity and a minor amount of a phenolic anti oxidant and a minor amount of viscosity index improver but which does not contain aminic anti oxidant.

DETAILED DESCRIPTION OF THE INVENTION

A gas engine oil is described comprising a major amount of a base oil of lubricating viscosity and a minor amount of phenolic type anti oxidant and viscosity index improver but which does not contain aminic anti oxidant. Also described is a method for enhancing the life of gas engine oils as evidenced by a reduction in viscosity increase, oxidation, nitration, TAN increase, and TBN depletion, by adding to a gas engine oil a minor amount of a phenolic anti oxidant and a viscosity index improver, but does not contain aminic anti oxidants.

The lubricating oil base stock is any natural or synthetic lubricating base oil stock fraction having a kinematic viscosity at 100° C. of about 5 to 20 cSt, more preferably about 7 to 16 cSt, most preferably about 9 to 13 cSt. In a preferred embodiment the use of the viscosity index improver permits the omission of oil of vis about 20 cSt or more at 100° C. from the lube base oil fraction used to make the present formulation. Therefore, a preferred base oil is one which contains little, if any, heavy fraction, e.g., little, if any, lube oil fraction of viscosity 20 cSt or higher at 100° C.

The lubricating oil basestock can be derived from natural lubricating oils, synthetic lubricating oils or mixtures thereof. Suitable lubricating oil basestocks include basestocks obtained by isomerization of synthetic wax and slack wax, as well as hydrocrackate basestocks produced by hydrocracking (rather than solvent extracting) the aromatic and polar components of the crude.

Natural lubricating oils include animal oils, vegetable oils (e.g., rapeseed oils, castor oils and lard oil), petroleum oils, mineral oils, and oils derived from coal or shale.

Synthetic oils include hydrocarbon oils and halo-substituted hydrocarbon oils such as polymerized and inter-polymerized olefins, alkylbenzenes, polyphenyls, alkylated diphenyl ethers, alkylated diphenyl sulfides, as well as their derivatives, analogs and homologs thereof, and the like. Synthetic lubricating oils also include alkylene oxide polymers, interpolymers, copolymers and derivatives thereof wherein the terminal hydroxyl groups have been modified by esterification, etherification, etc. Another suitable class of synthetic lubricating oils comprises the esters of dicarboxylic acids with variety of alcohols. Esters useful as synthetic oils also include those made from $C_5$ to $C_{12}$ monocarboxylic acids and polyols and polyol ethers.

Silicon-based oils (such as the polyakyl-, polyaryl-, polyalkoxy-, or polyaryloxy-siloxane oils and silicate oils) comprise another useful class of synthetic lubricating oils. Other synthetic lubricating oils include liquid esters of phosphorus-containing acids, polymeric tetrahydrofurans, polyalphaolefins, and the like.

The lubricating oil may be derived from unrefined, refined, rerefined oils, or mixtures thereof. Unrefined oils are obtained directly from a natural source or synthetic source (e.g., coal, shale, or tar sand bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating refined oils in processes similar to those used to obtain the refined oils. These rerefined oils are also known as reclaimed or reprocessed oils and often are additionally processed by techniques for removal of spent additives and oil breakdown products.

Lubricating oil base stocks derived from the hydroisomerization of wax may also be used, either alone or in combination with the aforesaid natural and/or synthetic base stocks. Such wax isomerate oil is produced by the hydroisomerization of natural or synthetic waxes or mixtures thereof over a hydroisomerization catalyst.

Natural waxes are typically the slack waxes recovered by the solvent dewaxing of mineral oils; synthetic waxes are typically the wax produced by the Fischer-Tropsch process.

The resulting isomerate product is typically subjected to solvent dewaxing and fractionation to recover various fractions of specific viscosity range. Wax isomerate is also characterized by possessing very high viscosity indices, generally having a VI of at least 130, preferably at least 135 and higher and following dewaxing, a pour point of about −20° C. and lower.

The production of wax isomerate oil meeting the requirements of the present invention is disclosed and claimed in U.S. Pat. Nos. 4,049,299 and 4,158,671.

Phenolic anti oxidants useful in the present invention include any compounds containing hydroxy groups bound directly to an aromatic ring and which are substantially non-volatile at peak engine operating temperatures. By substantially non-volatile is meant that there is less than 10% phenol volatility at about 150° C., preferably at about 175° C., most preferably at about 200° C. and higher. The term "phenol type" used herein includes compounds having one or more than one hydroxy group bound to an aromatic ring which may itself be mononuclear, e.g., benzyl, or polynuclear, e.g., naphthyl and spiro aromatic compounds. Thus "phenol type" includes phenol per se, catechol, resorcinol, hydroquinone, naphthol, etc., as well as alkyl or alkenyl and sulfurized alkyl or alkenyl derivatives thereof, and bisphenol type compounds including such biphenol compounds linked by alkylene bridges or sulfur or oxygen bridges. Alkyl phenol include mono- and poly-alkyl or alkenyl phenols, the alkyl or alkenyl group containing from about 3–100 carbons, preferably 4 to 50 carbons and sulfurized derivatives thereof, the number of alkyl or alkenyl groups present in the aromatic ring ranging from 1 to up to the available unsatisfied valences of the aromatic ring remaining after counting the number of hydroxyl groups bound to the aromatic ring.

Generally, therefor, the "phenolic type" anti oxidant may be represented by the general formula:

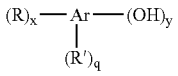

where Ar is selected from the group consisting of:

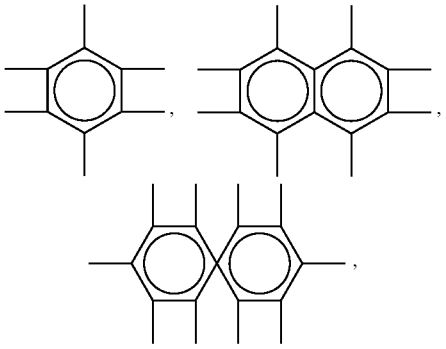

-continued

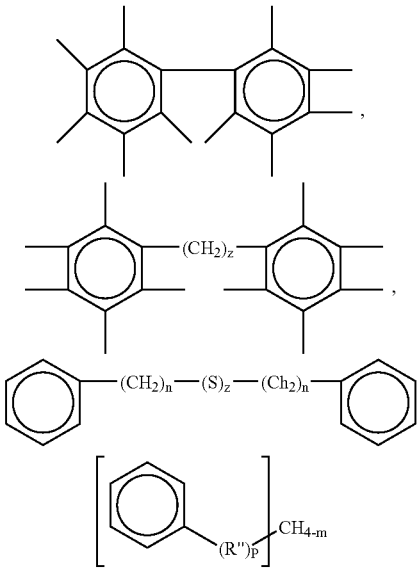

wherein R is a $C_3$–$C_{100}$ alkyl or alkenyl group, a sulfur substituted alkyl or alkenyl group, preferably a $C_4$–$C_{50}$ alkyl or alkenyl group or sulfur substituted alkyl or alkenyl group, more preferably $C_3$–$C_{100}$ alkyl or sulfur substituted alkyl group, most preferably a $C_4$–$C_{50}$ alkyl group, y ranges from 1 to up to the available valences of Ar, x ranges from 0 to up to the available valances of Ar−y, Q ranges from 0 to up to the available valences of Ar−(x+y+p), z ranges from 1 to 10, n ranges from 0 to 20, and m is 0 to 4 and P is 0 or 1, preferably y ranges from 1 to 3, x ranges from 0 to 3, z ranges from 1 to 4 and n ranges from 0 to 5, p is 0 and Q is 0 or 1.

Preferably, the phenolic type anti oxidant does not contain any N or S heteroatoms either as bridging moiety or as N or S containing substituted groups.

Most preferably the phenol is a hindered phenol such as di isopropyl phenol, di-tert butyl phenol, di tert butyl alkylated phenol where the alkyl substitutent is hydrocarbyl and contains between 1 and 20 carbon atoms, such as 2,6 di-tert butyl-4 methyl phenol, 2,6-di-tert butyl-4-ethyl phenol, etc., or 2,6 di-tert butyl 4-alkoxy phenol.

Phenolic type anti oxidants are well known in the lubricating industry and to those skilled in the art. The above is presented only by way of exemplification, not limitation on the type of phenolic anti oxidants which can be used in the present invention.

The amount of phenolic type anti oxidant used ranges from about 0.1 to 2 vol %, preferably about 0.3 to 1.75 V %, most preferably about 0.5 to 1.5 V %.

The oils of the present invention are essentially devoid of any aminic anti oxidants.

Viscosity index improvers useful in the present invention include any of the polymers which impact enhanced viscosity properties to the finished oil and are generally hydrocarbon-based polymers having a molecular weight, Mw, in the range of between about 2,000 to 1,000,000, preferably about 50,000 to 200,000. Viscosity index improver polymers typically include olefin copolymers, e.g., ethylene-propylene copolymers, ethylene-(iso-)butylene copolymers, propylene-(iso-)butylene copolymers, ethylene-poly alpha olefin copolymers, polymethocrylates; styrene-diene block copolymers, e.g., styrene-isoprene copolymers, and star copolymers. Viscosity index improvers may be monofunctional or multifuncational, such as those bearing substitutents that provide a secondary lubricant performance feature such as dispersancy, pour point depression, etc. In the present invention any multi functional viscosity index improver used will not possess aminic type anti oxidancy substitutents.

Viscosity index improvers are lubricant additives well known in the lubricant industry and to those skilled in the art. The above is presented only by way of example and not as a limitation on the types of viscosity index improvers which can be used in the present invention.

The amount of viscosity index improver used, be it mono functional or multifunctional, is in the amount of about 0.1 to 3 vol %, preferably about 0.2 to 2 V %, most preferably about 0.3 to 1.5 V %.

The fully formulated gas engine oil may contain additional, typical additives known to those skilled in the industry, used on an as-received basis.

Gas engine oils typically contain one or more detergents in varying amounts depending on whether the oil is classified as an ashless oil or a low, medium, or high ash content oil. The amount of detergent used and the type used is left to the practitioner to decide based on the final gas engine oil ash specification target. Detergents typically include alkali or alkaline earth metal salts. These metal salts may have Total Base Numbers (TBN) between about 25 to 500, preferably between about 50 to 300. The metal salt will usually be metal phenates, sulfonates or salicylates. The metal will usually be sodium, magnesium or calcium, preferably calcium and magnesium.

A preferred low ash gas engine oil detergent system is disclosed and claimed in U.S. Pat. No. 5,726,133 wherein the detergent comprises a mixture of detergents comprising at least one first alkali or alkaline earth metal salt or mixture thereof of low TBN of about 250 or less and at least one second alkali or alkaline earth metal salt or mixture thereof which is more neutral than the first low TBN salt. Preferably this second salt has a TBN of about one half or less that of the first salt.

The fully formulated oil may contain dispersants of the type generally represented by succinimides (e.g., polyisobutylene succinic acid/anhydride (PIBSA)-polyamine having a PIBSA molecular weight of about 700 to 2500). The dispersants may be borated or non-borated. The dispersant can be present in the amount of about 0.5 to 8 vol %, more preferably in the amount of about 1 to 6 vol %, most preferably in the amount of about 2 to 4 vol %.

Metal deactivators may be of the aryl thiazines, triazoles, or alkyl substituted dimercapto thiadiazoles (DMTD's), or mixtures thereof. Metal deactivators can be present in the amount of about 0.01 to 0.2 vol %, more preferably in the amount of about 0.02 to 0.15 vol %, most preferably in the amount of about 0.05 to 0.1 vol %.

Antiwear additives such as metal dithiophosphates (e.g., zinc dialkyl dithiophosphate, ZDDP), metal dithiocarbamates, metal xanthates or tricresylphosphates may be included. Antiwear additives can be present in the amount of about 0.05 to 1.5 vol %, more preferably in the amount of about 0.1 to 1.0 vol %, most preferably in the amount of about 0.2 to 0.5 vol %.

Pour point depressants such as poly(meth)acrylates, or alkyl-aromatic polymers may be included. Pour point depressants can be present in the amount of about 0.05 to 0.6 vol %, more preferably in the amount of about 0.1 to 0.4 vol %, most preferably in the amount of about 0.2 to 0.3 vol %.

Antifoamants such as silicone antifoaming agents can be present in the amount of about 0.001 to 0.2 vol %, more preferably in the amount of about 0.005 to 0.15 vol %, most preferably in the amount of about 0.01 to 0.1 vol %.

Lubricating oil additives are described generally in "Lubricants and Related Products" by Dieter Klamann, Verlag Chemie, Deerfield, Fla., 1984, and also in "Lubricant Additives" by C. V. Smalheer and R. Kennedy Smith, 1967, page 1–11, the disclosures of which are incorporated herein by reference.

Experimental a) Lab Nitration Screener Test Results

A lab nitration screener test was used in initial testing to guide in the selection of antioxidants, and viscosity index improvers (VIIs). The test results identify a number of parameters for assessing the used oil performance, including viscosity increase, oxidation, nitration, TAN increase, and TBN depletion. All measurements are reported so that large results (e.g., viscosity increase, or TBN depletion) represent greater levels of lubricant degradation. Thus, numerically lower results represent a measure of longer oil life. In each test, a Reference Oil is always tested. All results are reported as a ratio of the result for the Candidate Oil divided by the result for the Reference Oil. For example, if a Candidate Oil has an oxidation result of 1.0, then it has an oxidation performance equal to that of the Reference Oil. If the Candidate Oil has an oxidation result less than 1.0, then the Candidate Oil demonstrates oxidation performance superior to that of the Reference Oil.

The reference oil is an oil using as base oil a mixture of hydrocracked 500N base oil and solvent refined 1200N base oil, to which is added a pour point depressant and about 9.6 vol % of a commercial additive, Oloa 1255 (NGEO additive System B) which is believed to impart a net treat rate of about 0.4 vol % BHT (phenolic anti oxidant) in the formulated oil. Oloa 1255 is one of the most widely sold gas engine oil additive packages and represents, therefore, a "benchmark standard" against which other formulations may be measured.

EXAMPLES

Lab nitration screener test results are summarized in Table 1. A first series of results, candidate formulations 1 through 9, employ the identical core additive package (NGEO Additive System A), and are toptreated with different antioxidants. Results are measured relative to Reference Oil 1. The toptreats include antioxidants which are amine only, phenol only, and phenol/amine combinations (one of which is made up of about 80% aminic component, and 20% phenolic component, and the other of which is made up of about 70% aminic component and 30% phenolic component). Results show that the candidate oils with the longest life (i.e., lowest values of viscosity increase, oxidation, nitration, TAN increase, TBN depletion) are those formulations including phenol only antioxidants. Indeed, the results with phenol only show the longest life, with all used oil parameters less than 1.0 (thus, all results show longer life relative to the Reference Oil).

A second series of results, Candidate Formulations 10 through 13, investigates the combined benefits of antioxidants and VIIs. It should be noted that the use of VIIs in multigrade gas engine oils has been established for over two decades. The present candidate formulations, however, differ in that they use low treats of VII as a thickener to simply boost the base formulation to a target viscosity of 13.2 cSt at 100° C. The low treat of VII allows a heavy 1200 SN solvent refined basestock (vis of about 20.8 cSt at 100° C.) to be eliminated from the formulation, but is insufficient to have them considered as a multigrade oil. Candidate Formulation 10 differs from Reference Oil 1 only by using phenol only instead of amine only anti oxidant. Examining the lab screener results for Candidate Formulation 10 therefore confirms the benefits for using phenol antioxidant versus an amine antioxidant. Candidate Formulation 11 includes a monofunctional VII in addition to the components used in Candidate Formulation 10. Results show that the inclusion of the VII offers additional benefits for controlling viscosity increase, oxidation, and TAN increase.

It must also be pointed out that Candidate Oils 11 and 13 each also exhibited a considerable and unexpected improvement in the nitration level as compared against any other oil except Candidate Oil 10, which was similar in terms of nitration performance but substantially equivalent to the Reference Oil in TAN delta. By comparison, Candidate Oils 11 and 13 exhibited not only an improvement in oxidation but also an improvement in TAN delta relative to the Reference Oil showing the overall superiority of the phenolic type anti oxidant-viscosity index improver combination of the present invention.

NGEO Additive System B is a gas engine oil additive package which is believed to contain BHT, a phenolic type anti oxidant, which gives a finished oil anti oxidant content of about 0.4 vol %. Thus, the presence of a phenol anti oxidant in gas engine oil is known. Further, multigrade oils containing solvent extracted base oil, Additive System B and a high treat rate of viscosity index improver (about 8–11 vol %) so as to meet a SAE J-300 specification, but also containing 70% amine/30% phenol type anti oxidant mix as a supplementary anti oxidant, is also known.

The formulations of the present invention distinguish over those earlier formulations in that they contain viscosity index improvers at a low treat rate, not in an amount sufficient to produce a multi grade product, and further, the exclusive anti oxidant used is of the phenolic type, any aminic anti oxidant being excluded from the formulation. That this last difference is significant is seen by comparing Candidate Oils 4, 5, 6 and 7 against Candidate Oils 8, 9 and by comparing Candidate Oils 11 and 13 (oils of the present invention) against Candidate Oil 12.

It is seen that the oils containing aminic anti oxidants generally exhibit a lesser degree of improvement in terms of viscosity increase, oxidation, nitration, TAN delta and TBN depletion as compared against oils containing only phenol (Oils 4–7 vs. Oils 8 and 9), and that when oils containing viscosity index improver are considered, such oil containing amine anti oxidants (Oil 12) is markedly inferior in all measurement categories as compared against Oils 11 and 13, formulations of the present invention.

TABLE 1

| | | CANDIDATE OIL | | | | | | | | | | | | | |
|---|---|---|---|---|---|---|---|---|---|---|---|---|---|---|---|
| | | Ref Oil 1 | 1 | 2 | 3 | 4 | 5 | 6 | 7 | 8 | 9 | 10 | 11 | 12 | 13 |
| NGEO additive system (in vol %) | | | A | A | A | A | A | A | A | A | A | B | B | B | B |
| Additive System A* | | | ←---------- | | | | 6.98 | | | | ----------→ | | | | |
| | pour point depressant | 0.50 | 0.400 | 0.400 | 0.400 | 0.400 | 0.400 | 0.400 | 0.400 | 0.400 | 0.400 | 0.500 | 0.500 | 0.500 | 0.500 |
| Additive System B | | 9.6 | — | — | — | — | — | — | — | — | — | 9.6 | 9.6 | 9.6 | 9.6 |
| | Hydrocracked 500N base | 77.55 | 87.120 | 87.120 | 87.120 | 87.120 | 86.620 | 87.120 | 86.620 | 87.120 | 86.620 | 82.200 | 88.150 | 88.380 | 88.200 |
| | Solvent Refined 1200N base | 11.35 | 5.000 | 5.000 | 5.000 | 5.000 | 5.000 | 5.000 | 5.000 | 5.000 | 5.000 | 6.700 | — | — | — |
| Supplementaiy Antioxidants/Viscosity Index Improvers | | | | | | | | | | | | | | | |
| | Amine-1 only a/o | 1.00 | 0.50 | — | — | — | — | — | — | — | — | — | — | 1.00 | — |
| | Amine-2 only a/o | — | — | 0.50 | — | — | — | — | — | — | — | — | — | — | — |
| Irganox L118 | Phenol-1 only a/o | — | — | — | 0.50 | — | — | — | — | — | — | — | — | — | — |
| | 20% Phenol/80% Amine a/o Mix 1 | — | — | — | — | 0.50 | 1.00 | — | — | — | — | — | — | — | — |
| | 30% Phenol/70% Amine a/o Mix 2 | — | — | — | — | — | — | 0.50 | 1.00 | — | — | — | — | — | — |
| Irganox L135 | Phenol-2 only a/o | — | — | — | — | — | — | — | — | 0.50 | 1.00 | 1.00 | 1.00 | — | 100 |
| PTN 8024 | Monofunctional OCP VII | — | — | — | — | — | — | — | — | — | — | — | 0.75 | — | — |
| TLA 6723 | Multifunctional OCP VII | — | — | — | — | — | — | — | — | — | — | — | — | 0.52 | 0.70 |
| Results (Ratio: Candidate and/reference oil) | | | | | | | | | | | | | | | |
| Number of tests | | — | 1 | 1 | 1 | 1 | 1 | 1 | 1 | 1 | 1 | 2 | 2 | 2 | 2 |
| % Visc Inc | | 1.00 | 0.56 | 0.52 | 0.39 | 0.55 | 0.63 | 0.57 | 0.72 | 0.36 | 0.44 | 0.91 | 0.78 | 0.81 | 0.76 |
| Oxidation (abs/cm) | | 1.00 | 0.65 | 0.62 | 0.53 | 0.54 | 0.55 | 0.6 | 0.59 | 0.46 | 0.44 | 0.86 | 0.78 | 0.9 | 0.77 |
| Nitration (abs/cm) | | 1.00 | 1.05 | 1.05 | 0.92 | 0.97 | 0.91 | 1.11 | 1.05 | 0.91 | 0.8 | 0.68 | 0.68 | 0.96 | 0.69 |
| TAN Delta | | 1.00 | 1.57 | 1.41 | 2.14 | 0.66 | 0.51 | 1.22 | 2.28 | 0.54 | 0.47 | 1.02 | 0.76 | 1.34 | 0.75 |
| TBN (% Depleted) | | 1.00 | 0.97 | 0.98 | 0.93 | 0.98 | 1.04 | 1.01 | 1.03 | 0.8 | 0.78 | 0.93 | 0.93 | 1.14 | 0.94 |

*Additive System A contains calcium phenate and calcium sulfonate detergents, a dispersant, a metal deactivator, an anti wear agent and an antifoamant, but no amine or phenol type anti oxidants.

Oil Additive Packages

A = Low Ash Additive system with 0.45% ash content

B = Additive system with 0.45% ash content. It is believed that the additive system imparts a net treat rate of about 0.4 vol % of BHT antioxidant in the formulated oil.

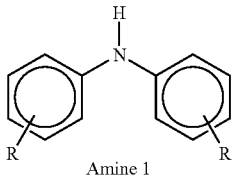

Amine 1
R = H, $C_9$ mix

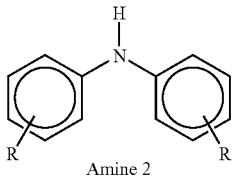

Amine 2
R = $C_4$–$C_8$

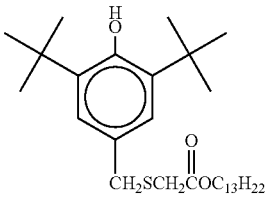

Phenol 1

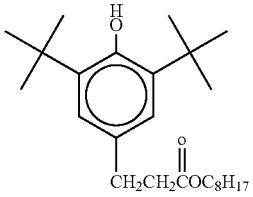

Phenol 2

Amine/Phenol Mix 1 is a mixture of Amine 2 and Phenol 4.

Amine/Phenol Mix 2 is a mixture of Amine 2 and a mixture of Phenol 4 and Phenol 3.

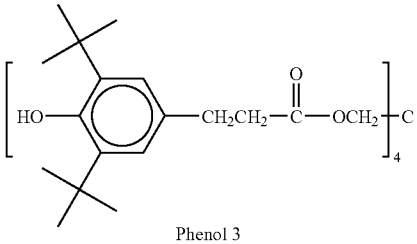

Phenol 3

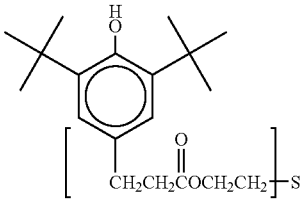

Phenol 4 b) Lab Engine Test

Lab engine testing was completed to verify the screener results. The used oil properties from the engine test are summarized pictorially in FIGS. 1A, 1B and 1C. The results are expressed in terms of absolute levels of viscosity increase (%) (FIG. 1A), oxidation (absorbance units/cm) (FIG. 1B), and nitration (absorbance units/cm) (FIG. 1C). The results show duplicate test data for Reference Oil 1 (these are marked on the graphs as Reference Oil 1 —Test 1, and Reference Oil 1—Test 2), and verify that the engine test provides repeatable results. Candidate Oil 11 is identified in FIGS. 1A, 1B and 1C as "Invention", and shows significant improvements in viscosity increase, oxidation and nitration relative to Reference Oil 1. For additional reference, two competitive oils (Commercial Oil 1 and Commercial Oil 2) are also shown on this graph. These two commercial oils are relevant, because they are strongly believed to be formulated with the same additive package (Additive System B), and also use severely hydrofinished basestocks.

c) Field Demonstration Results

FIG. 2 shows results from a field demonstration of the invention. Reference Oil 2 uses Additive System B, and solvent extracted basestocks. Reference Oil 1 is identified in this graph as Reference Oil 1, and represents data collected over many years. The left data point for Reference Oil 1 (1190 hours) represents a drain interval prior to optimization of the engine tuning parameters (fuel mixture, timing, etc.). The right data point for Reference Oil 1 (1480 hours) represents the drain interval after optimization of the engine tuning parameters. More importantly, this second data point for Reference Oil 1 represents operation of the engine just prior to testing of the invention. The invention is identified in FIG. 2 as "Invention", and identifies an oil drain interval of 2083 hours. These results demonstrate the benefits of the invention.

The invention claimed is:

1. A method for enhancing the life of gas engine oils as evidenced by a reduction in at least one of viscosity increase, oxidation, nitration, TAN increase, and TBN depletion of the gas engine oil during use comprising formulating a gas engine oil comprisinig a base stock having a viscosity at 100° C. of from 9 to 13 cSt, the base stock being a synthetic, hydrocracked or solvent refined oil or mixture thereof a minor amount of an anti oxidant in the range of about 0.1 to 2 vol %, from about 0.2 to about 0.5 vol % of antiwear additives, and an amount of a viscosity index improver not sufficient to produce a multi-grade gas engine oil lubricating composition, the amount used being in the range of about 0.1 to 3 vol % which gas engine oil lubricating composition does not contain aminic anti oxidants and wherein the anti oxidant is selected from the group consisting of phenolic anti oxidants, and a minor amount of a low ash gas engine oil detergent system having a TBN of about 50 to about 300 wherein the gas engine oil has a low ash content in the range of 0.1 to 0.6 wt % and wherein the life of said as engine oil is enhanced in comparison to gas engine oils which do not contain both phenolic anti oxidant(s) and viscosity index improver(s).

2. The method of claim 1 wherein the phenol anti oxidant is added to the lubricating oil in an amount in the range of about 0.3 to 1.75 vol % and the viscosity index improver is added to the lubricating oil in an amount in the range of about 0.2 to 2 vol %.

3. The method of claim 1 wherein the base stock is a mixture of a hydrocracked oil and a solvent refined oil.

4. The method of claim 1, 2 or 3 wherein the detergent system is a mixture of detergents comprising at least one first alkali or alkaline earth metal salt or mixture thereof having a TBN below about 250 and at least one second alkali or alkaline earth metal salt or mixture thereof having a TBN of about one-half or less of the first salt.

* * * * *